US005089677A

United States Patent [19]

Satou

[11] Patent Number: 5,089,677

[45] Date of Patent: Feb. 18, 1992

[54] SWITCHING DIAL AND FINGER REST

[75] Inventor: Kouji Satou, Shiki, Japan

[73] Assignee: Asahi Kogaku Kogyo K.K., Tokyo, Japan

[21] Appl. No.: 656,028

[22] Filed: Feb. 15, 1991

Related U.S. Application Data

[60] Continuation of Ser. No. 452,391, Dec. 19, 1989, abandoned, which is a division of Ser. No. 283,961, Dec. 13, 1988, Pat. No. 4,918,264.

[30] Foreign Application Priority Data

Dec. 26, 1987 [JP] Japan ..... 62-198050
Jul. 29, 1988 [JP] Japan ..... 63-100695

[51] Int. Cl.[5] ..... H01H 23/30
[52] U.S. Cl. ..... 200/339
[58] Field of Search ..... 200/339, 553, 564, 11 TW

[56] References Cited

U.S. PATENT DOCUMENTS

| | | | |
|---|---|---|---|
| 3,408,463 | 3/1967 | Wanlass | 200/302.3 |
| 3,703,613 | 11/1972 | Abel | 200/11 TW |
| 3,806,685 | 4/1974 | Seeger et al. | 200/517 |
| 4,218,593 | 8/1980 | Mayer et al. | 200/11 TW |
| 4,408,103 | 10/1983 | Smith, III | 200/517 |
| 4,499,342 | 2/1985 | Nakayama | 200/5 A |
| 4,506,118 | 3/1985 | Mollman | 200/16 R |
| 4,536,628 | 8/1985 | Willhaus | 200/513 |
| 4,614,847 | 9/1986 | Sasao | 200/6 A |
| 4,654,488 | 3/1987 | Westfall | 200/552 |
| 4,687,200 | 8/1987 | Shirai | 200/5 A |
| 4,710,602 | 12/1987 | Baity et al. | 200/5 A |
| 4,733,024 | 3/1988 | Takeshima et al. | 200/6 R |

OTHER PUBLICATIONS

Magazine Article *The Cannon EOS 650*, p. 34 "Photo-Graphic"-May 1987.

*Primary Examiner*—Renee S. Luebke
*Attorney, Agent, or Firm*—Sandler, Greenblum & Bernstein

[57] ABSTRACT

A switching device comprising a rubber switch, an operating member displaceable between at least two operative positions and a neutral position, and a cooperating member shiftable between the at least two cooperative positions and neutral position in response to displacement of the operating member. The operating member and the cooperating member are held in their neutral position due to the resilience of the rubber switch, while one contact is brought into engagement with a corresponding conductive element in the rubber switch when the corresponding member is shifted to one of the cooperative positions in response to the displacement of the operating member against the resilience of the rubber switch. The operating member includes a dial and a finger rest which in combination allows a finger of the user to be simultaneously placed on both the dial and finger rest.

10 Claims, 11 Drawing Sheets

SWITCHING DIAL AND FINGER REST

This application is a continuation, of application Ser. No. 07/452,391, filed Dec. 19, 1989, now abandoned which is a division of serial No. 07/283,961, filed Dec. 13, 1988, now U.S. Pat. No. 4,918,264.

BACKGROUND OF THE INVENTION

This invention relates to a switching device using a so-called rubber switch, and more particularly to a rotatable dial mechanism used as a select switch incorporating a rubber switch.

Cameras and like equipment incorporating electronic circuits are provided with different kinds of switches. Recently, rubber switches have been increasingly used to satisfy the requirement for more compactness and thinness of such equipment.

FIG. 13 shows one example of such rubber switches. The rubber switch 11 is made by molding rubber or a similar resilient material and has a pair of projections 13 that are pressed by an operating member (not shown). The top inner surface of the projections 13 are integrally provided with contacts 12 opposite to conductors 14*a* of a substrate 14. The contacts 12 are held out of contact with the conductors 14*a* of the substrate 14 due to the resilience of the projections 13. The rubber switch 11 is thus electrically turned on through engagement of one contact 12 with the conductor 14*a* of the substrate 14 by alternatively depressing the projections 13 with the operating member. Releasing the operating member from the projections 13 then returns the switch to the initial non-contact position.

Also, there is a switch mechanism with the rubber switch 11 as mentioned above wherein a pair of projections 13 are alternatively pressed, which has conventionally been provided with means for restoring the neutral or off (on) position, but this results in a complicated structure. For a switch mechanism without any rubber switch, it has been necessary to provide the operating member itself with switching contacts in addition to incorporating the means restoring the neutral or off (on) position. This has again made such a switch mechanism complicated in construction.

Also known is a rotatably operable dial mechanism used as a momentary switch to operate the aforementioned rubber switch. The momentary switch turns a motor forward and backward in dependence on the direction of rotation of a rotatable dial. It returns to the neutral position with release of the operating force. In recent electronic cameras, different modes of camera operation as well as manual shutter speeds are often selected by complex operation of two different switches. In this case, one of the two switches may be a rotatable dial mechanism (select switch) rotatably movable between the neutral, right and left operative positions.

Such a rotatable dial mechanism achieves its primary function basically with a finger seating part provided on the rotatable dial. However, it has been difficult to produce such a rotatable dial which is stable when a finger is seated but does not turn the dial, while at the same time ensuring ease of rotational operation. In case of blind operation, it has sometimes caused operational mistakes and dislocation of the dial itself.

SUMMARY OF THE INVENTION

It is therefore an object of the invention to provide an improved switching device capable of returning to the neutral position of the operating member or centering itself by the of resilience of a rubber switch, with no need of a return spring on the operating member itself to restore it to the neutral position.

Another object of the invention is to provide a dial type switching device capable of holding a finger in position when it does not turn the dial, while ensuring greater ease of rotational operation, and which is easy to be touched during blind operation with a minimum possibility of operational mistake, with a good feel of touch and a neat appearance.

For the above purposes, according to the invention, a switching device which comprises a rubber switch including at least a pair of contacts provided on a resilient member which are adapted to be brought into and out of engagement with a pair of corresponding conductive elements on a substrate. The pair of contacts are normally held out of engagement with the conductive elements the of resilience of the resilient member.

An operating member is displaceable between at least two operative positions and a neutral position, and a cooperating is shiftable between at least two cooperative positions and the neutral position in response to the displacement of the operating member.

The operating member and the cooperative member are held in their neutral positions due to the resilience of the resilient member of the rubber switch, while one of the contacts is brought into engagement with the conductive elements when the cooperating member is shifted to one of the cooperative positions in response to the displacement of the operating member to one of the operative positions against the resilience of the resilient member.

DESCRIPTION OF THE ACCOMPANYING DRAWINGS

FIGS. 1A, 1B and 1C show a basic structure of the operating member used for the switching device embodying the invention, wherein FIG. 1A is a sectional view showing a planar operating member, FIG. 1B illustrates a concave operating member and FIG. 1C illustrates a convex operating member C.

DESCRIPTION OF THE EMBODIMENTS

Figure 1A:
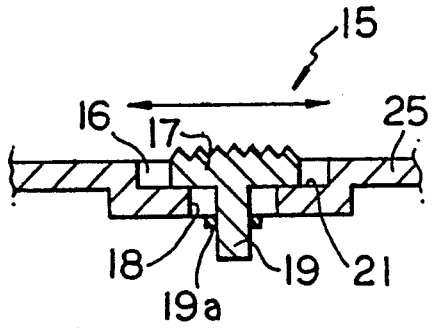
Figure 1B:
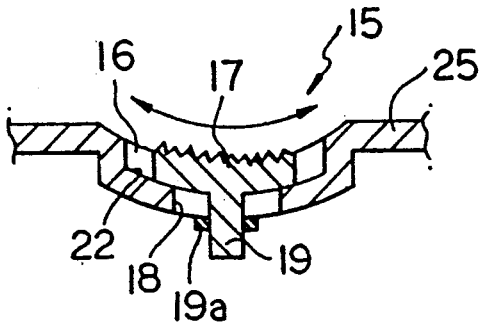
Figure 1C:
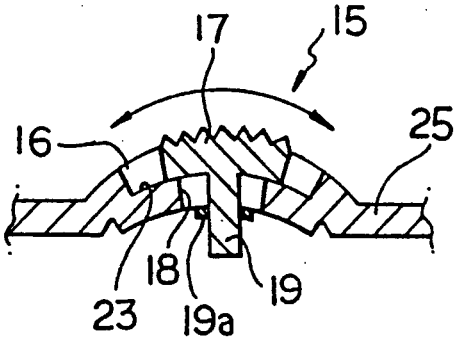

FIGS. 1A, 1B, and 1C show the basic structure of operating members 15 used for a switching device embodying the invention. The operating members 15 shown in these figures each includes, as common components, an operating knob 17 movable in the directions indicated by the arrows within a knob receiving recess 16, and an actuator projection 19 in connection with the operating knob 17 that projects into a case 25 through an access window 18 in the knob receiving recess 16. The operating members 15 comprise a planar shape A in FIG. 1A, a concave shape in FIG. 1B, and a convex shape in FIG. 1C depending on the planar receiving surface 21, the concave surface 22 or the convex surface 23 formed in the knob receiving recess 16.

The switching device according to the invention comprises the operating member 15 of any one of the above mentioned three types, and one of the different types of cooperating pressing elements 20 to be described in connection with the embodiments illustrated in FIG. 2A and the subsequent figures, which pressing elements are in operative association with the operating knob 17 to alternatively depress the projections 13 of the rubber switch 11 so as to alternatively bring at least a pair of contacts 12 into and out of engagement with the substrate 14. A retainer 19*a* retains the operating knob in the knob receiving recess 16.

Figure 2A:
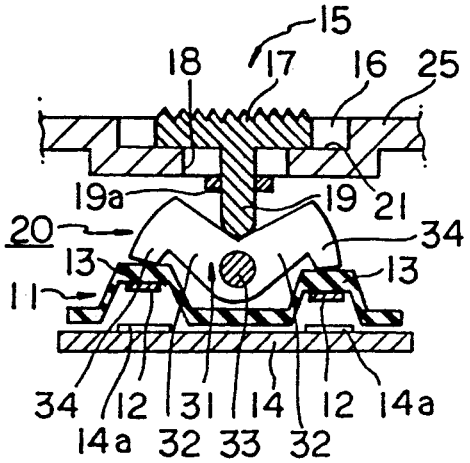
FIGS. 2A and 2B are sectional views showing a first embodiment of the invention.
Figure 2B:
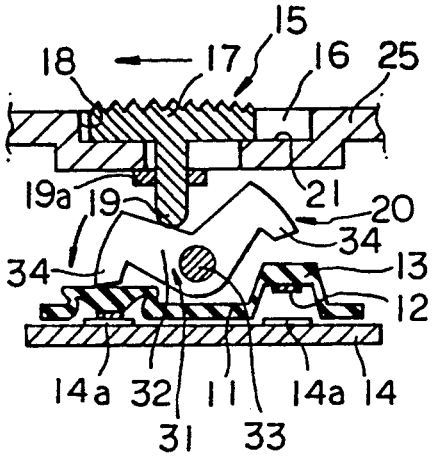

FIGS. 2A and 2B show a first embodiment of the invention, wherein the planar shaped operating member is used with the cooperating pressing element 20. In this embodiment, the cooperating pressing element 20 consists of a rotatable operating lever 31. The rotatable operating lever 31 forms a V shape with a pair of pressure arms 32 corresponding to the contacts 12 of the rubber switch 11. The center of the V shape lever 31 is pivotally mounted on a rotary shaft 33. The pressure arms 32 are both provided at their free ends with pressure pieces 34 bent toward the projections 13 of the rubber switch 11. The rotary shaft 33 is located above the rubber switch 11 between the pair of projections 13, with the actuator projection 19 being received in the apex of the V-shape of the rotatable operating lever 31. The lever 31 is held in a neutral position by the resilience of the projections 13. The lever 31 is therefore in a position where each pressure piece 34 does not depress any projection 13 when the operating knob 17 is in its neutral position.

When the operating knob 17 is moved from the neutral position in either the right-hand or left-hand direction in the drawings, the leading end of the actuator projection 19 comes into sliding contact with one of the pair of pressure arms 32 to rotate it counterclockwise or clockwise about the shaft 33 so that a pressure piece 34 depresses a projection 13. Consequently, one of the contact pair 12 is alternatively brought into contact with the substrate 14 to establish an electrical connection as shown in FIG. 2B. When the operating force of the operating knob 17 is released, the rotary operating lever 31 rotatably returns to the initial position because of the resilience of projection 13, and at the same time, the contact 12 moves away from the contact 14*a* on the substrate 14 to restore the rubber switch 11 to its original state. It should be noted that the aforementioned rotatable operating lever 31 is also applicable to the concave operator or the convex operator.

Figure 3A:
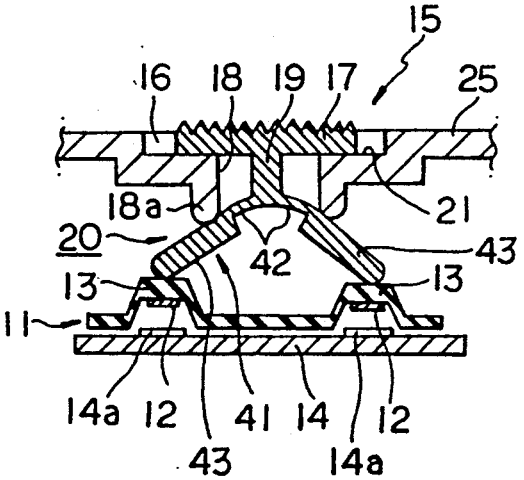
FIGS. 3A and 3B are sectional views showing a second embodiment of the invention.
Figure 3B:
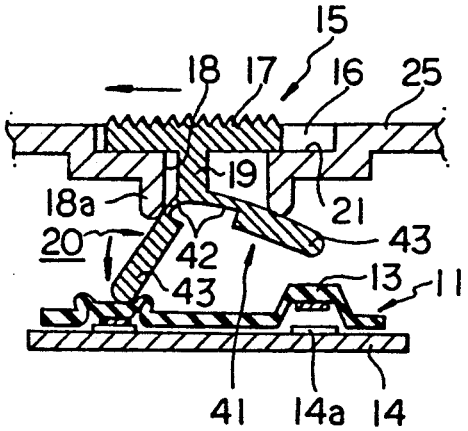

FIGS. 3A and 3B illustrate a second embodiment of the invention using the planar operator. In this embodiment, the cooperating pressing element 20 comprises of a flexible pressure arm 41 normally resting resiliently against the projections 13 with a restricted opening angle. The flexible pressure arm 41 includes a pair of thin resilient plates 42 extending from the leading end of the actuator projection 19.

The thin resilient plates 42 are formed with a pair of pressure arms 43 whose leading ends are adapted to press the projections 13 of the rubber switch 11. The opening angle of the pressure arms 43 is restricted by a circular edge 18*a* projecting from the lower end of the access window 18 into an interior space so that the leading ends of the pressure arms 43 are normally in resilient engagement with the projections 13 in the neutral position of the operating member 17.

With the aforementioned second embodiment, when the operating knob 17 is slidably moved from the neutral position in either the right-hand or left-hand direction in the drawings, the pressure arm pair 43 comes into sliding contact with the projecting edge 18*a* so that the one of the pressure arms, depresses the projection 13 due to the bending of the thin resilient plate 42 by overcoming the resilient force, while the other pressure arm moves away from the projection 13 by virtue of the resilience of the resilient plate 42. Consequently, one of the contact pair 12 is alternatively brought into contact with the contact 14*a* on the substrate 14 to establish an electrical connection as shown in FIG. 3B. When the operating force of the operating knob 17 is released, the pressure arm 43 pressing the projection 13 is moved up in sliding contact with the projecting edge 18*a* to remove the pressure that was applied to the projection 13, while the other pressure arm 43 is brought into resilient contact with its corresponding projection 13 due to the bending of the resilient plate 42 by resilient force. This returns the operating member 17 to its neutral position so that the contact pair 12 is brought out of engagement with the contact pair 14*a* on the substrate 14. It should be noted that the aforementioned pressure arm 41 is applicable to the concave operator or the convex operator.

Figure 4A:
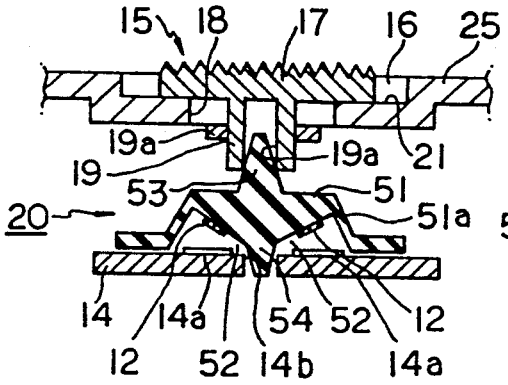
FIGS. 4A and 4B are sectional views showing a third embodiment of the invention.
Figure 4B:
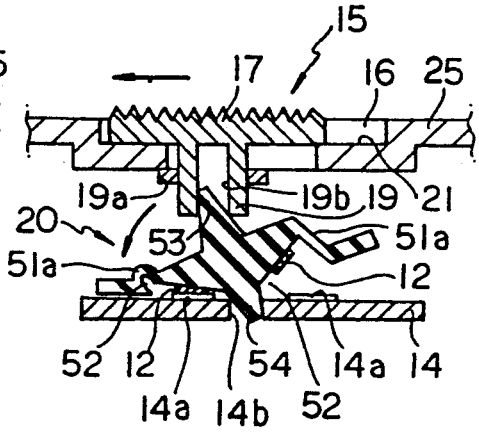

FIGS. 4A and 4B illustrate a third embodiment of the invention, which is also used with the planar operator. This embodiment provides an example of an arrangement where the cooperative pressing element 20 is formed on the rubber switch 51 itself. The rubber switch 51 includes a lower center projection 54 fitted in a retaining hole 14*b* in the substrate 14 for pivotal movement, while an upper cooperative projection 53 is fitted in a cooperative hole 19*b* in the actuator projection 19. Also, the rubber switch 51 includes internally symmetric slanted recesses 52, at the bottom of which a pair of contacts 12 are provided. The rubber switch 51 is normally held in neutral position where the right and left contacts 12 are separated from the contacts 14*a* on the substrate 14 because of its resilience.

With the third embodiment as mentioned above, when the operating knob 17 is slidably moved from the neutral position in a right-hand direction as shown in the drawings, the rubber switch 51 is pivotally displaced about the center projection 54 by way of the cooperative projection 53 fitted in the cooperative hole 19*b*. One of narrowed portions 51*a* is then flexed to bring one internal contact 12 into engagement with the contact 14*a* on the substrate 14. Electrical connection is thus established between one contact 12 and the substrate 14 as shown in FIG. 5B. When the operating knob 17 is released in this state, the rubber switch 51 swings in the opposite direction so that the contact 12 is removed from the contact 14*a* of the substrate 14 by virtue of resilience of the rubber switch, thus returning it to the position shown in FIG. 4A. It is noted that the rubber switch 51 is also applicable to the concave operator and the convex operator.

Figure 5A:
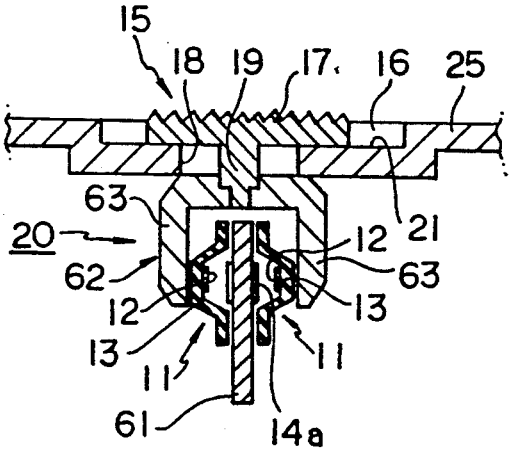
FIGS. 5A and 5B are sectional views showing a fourth embodiment of the invention.
Figure 5B:
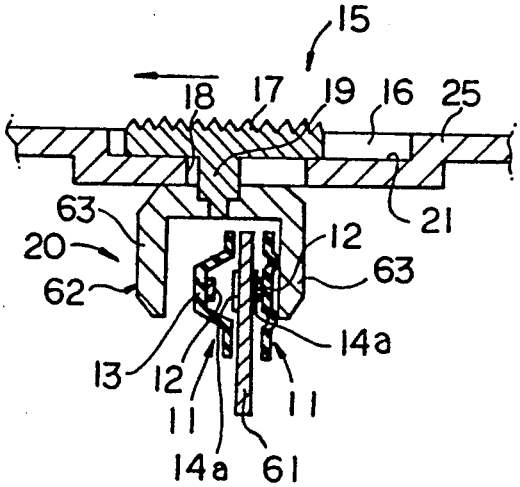

FIGS. 5A and 5B illustrate a fourth embodiment of the invention which is also used with the planar operator. In this embodiment, a double-sided substrate 61 is placed in a direction perpendicular to the sliding direction of the operating knob 17. A pair of rubber switches 11 are located symmetrically on each side of the double-side substrate 61. The latter is provided with a pair of contacts 14*a* with which the contacts 12 of the projection 13 are adapted to contact. The contacts 12 are normally kept out of engagement with the contacts 14*a* by means of the resilience of the projection 13. The cooperative pressing element 20 comprises a cooperative slide member 62 which pushes the projection 13 in the sliding direction of the operating knob 17. The cooperative slide member 62 has a pair of slide pressure pieces 63 which are located opposite to each other across the rubber switch pair 11, with its center fixed to the leading end of the actuator projection 19. Therefore, the cooperative slide member 62 is slidably movable with the operating knob 17.

With the fourth embodiment as mentioned above, when the operating knob 17 is moved from a neutral position in either the right-hand or left-hand direction in the drawings, the cooperative slide member 62 is moved together with the operating knob 17 in the same direction. As a result, one of the slide pressure pieces 63 presses one of the projections to selectively bring the contacts 12 into engagement with the contacts 14*a* of the substrate 14. This establishes an electrical connection between one contact 12 and the double-side substrate 61 as shown in FIG. 5B. When the operating knob 17 is released, the contact 12 moves away from the contact 14*a* on the substrate 14 due to the resilience of the projection 13 to return the operating knob 17 to its initial neutral position.

Figure 6A:
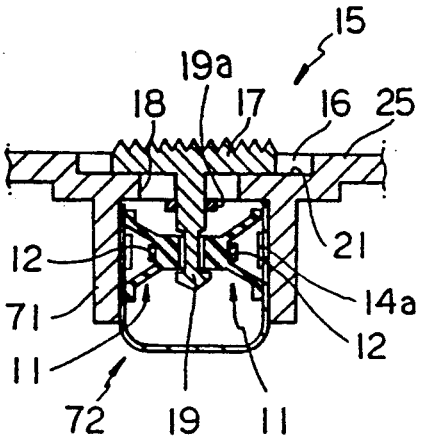
FIGS. 6A and 6B are sectional views showing a fifth embodiment of the invention.
Figure 6B:
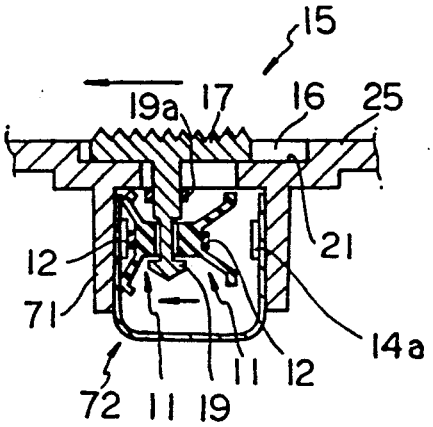

FIGS. 6A and 6B illustrate a fifth embodiment which is also used with the planar operator. Under the bottom of the case 25, mounting walls 71 are located opposite to each other on opposite sides of the access window 18. A U-shaped flexible substrate 72 is fitted along the inner side of the mounting walls 71. A pair of rubber switches 11 are symmetrically mounted on opposite sides of the actuator projection with each contact 12 opposite to the mounting wall 71 so as to be brought into engagement with the contact on the flexible substrate 72. Thus, the rubber switch pair 11 is slidably movable together and in the same direction with the operating knob 17 and the operating knob 17 is normally held in neutral position by the resilience of the rubber switch 11. It is noted that the rubber switch 11 may also be mounted on the side of the flexible substrate 72.

When the operating knob 17 is moved in either the right-hand or left-hand direction, the rubber switch pair 11 is moved in the same direction so that one of the rubber switch pair 11 is pressed against the mounting wall 71 through the flexible substrate 72. As a result, legs of one rubber switch 11 are opened further apart to bring the corresponding contact 12 into engagement with the flexible substrate 72 to establish electric connection between them as shown in FIG. 6B. When the operating knob 17 is then released, the contact 12 is moved away from the flexible substrate 72 by the resilience of the rubber switch 11 so that the operating knob 17 is returned to its initial neutral position. It should be noted that this arrangement may also be used with the concave operator and the convex operator.

Figure 7A:
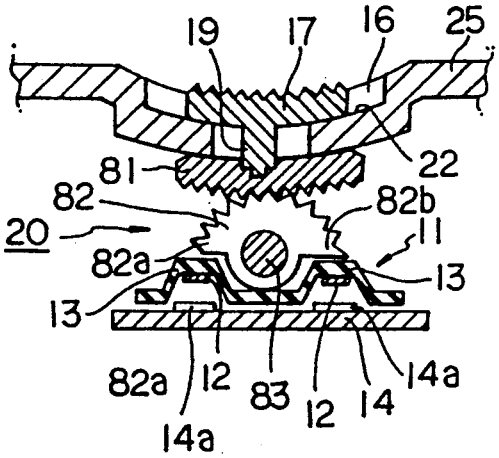
FIGS. 7A and 7B are sectional views showing a sixth embodiment of the invention.
Figure 7B:
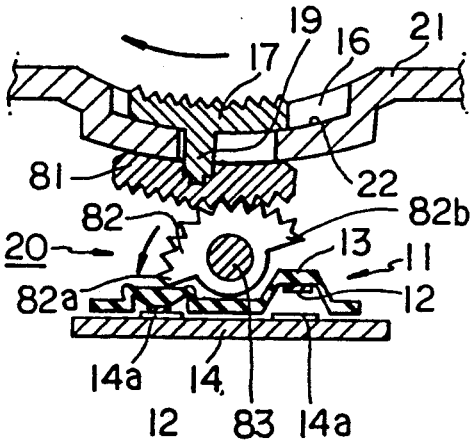

FIGS. 7A and 7B illustrate a sixth embodiment of the invention which is used with the concave operator. In this embodiment, the cooperative pressing element 20 comprises an arc-shaped rack 81 and a sector gear 82 in mesh with the rack 81. The rack 81 is fixedly mounted on the actuator projection 19 so that it is slidably movable together with the operating knob 17 in sliding contact with the under surface of the knob receiving recess 16. A sector gear 82 in mesh with the rack 81 is rotatable about a rotary shaft 83 upon movement of the rack 81. The right and left ends 82*a* and 82*b* of the sector gear 82 are located above the projections 13 to provide a pressure piece for each projection 13. The rubber switch 11 itself is of the same structure as the embodiments shown in FIGS. 2A, 2B and 3A, 3B.

When the operating knob 17 is slidably moved from the neutral position in either the right-hand or left-hand direction in the sixth embodiment, the rack 81 is moved together with the operating knob 17 in the same direction. As a result, the sector gear 82 in mesh with the rack 81 is rotated in the same direction to press one projection 13 with its one end 82*a* or 82*b*. The contacts 12 are then selectively brought into contact with the contacts 14*a* on the substrate 14 to establish an electrical connection between them as shown in FIG. 7B. When the operating knob 17 is released, the sector gear 12 is rotated back to the initial position due to the resilience of the projection 13, while at the same time the operating knob 17 is returned to the initial neutral position by the rack 81. In this embodiment, a shock experienced during engagement between the rubber switch 11 and the operating member 82 is minimized to ensure a smooth feeling of operation. This arrangement is applicable to the planar operator by using a planar-shaped rack 81.

Figure 8:
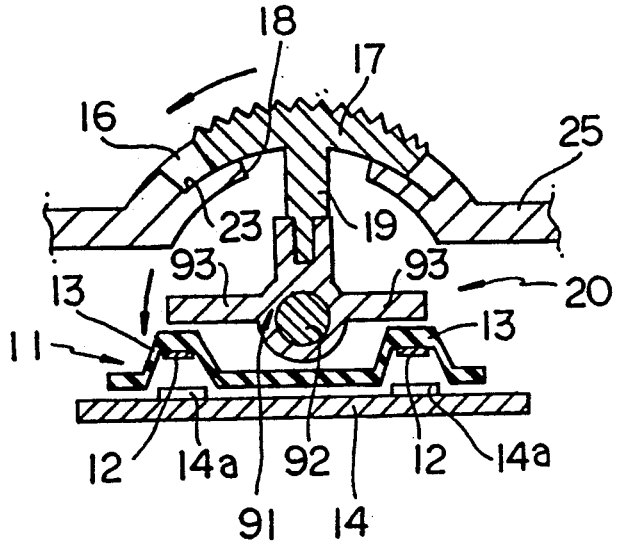
FIG. 8 is a sectional view showing a seventh embodiment of the invention.

FIG. 8 shows a seventh embodiment of the invention which is used with the convex operator. In this embodiment, the cooperative pressing element 20 comprises a rotatable pressure lever 91. The lever 91 is rotatably mounted at its center on a rotary shaft 92 located between the projections 13 above the rubber switch 11. The lever 91 includes a pair of press levers 93 extending from the rotary shaft 92 radially in parallel with the substrate 14. The lever 91 is fixedly mounted on the leading end of the actuator projection 19. The press lever pair 93 is located above the right and left projections 13. As a result, the rotatable pressure lever 91 is rotatably moved about the rotary shaft 92 together with and in the same direction as the sliding movement of the operating knob 17. The rubber switch 11 is the same structure as in the embodiments shown in FIGS. 2A, 2B and 3A, 3B.

With the above seventh embodiment, when the operating knob 17 is moved from the neutral position in either the right-hand or left-hand direction of the drawings, the rotatable pressure lever 91 is rotated together with the operating knob 17 in the same direction, so that one press lever 93 presses the corresponding one of the projections 13. The contacts 12 of the rubber switch 11 are therefore selectively brought into engagement with the contacts 14*a* on the substrate 14 to make an electrical connection between them. When the operating knob 17 is released, the rotatable pressure lever 91 is rotated back to the initial position due to the resilience of the projection 13. This allows the contact 12 to move away from the contact 14*a* of the substrate 14 and the operating knob 17 to return to the initial neutral position.

Figure 9:
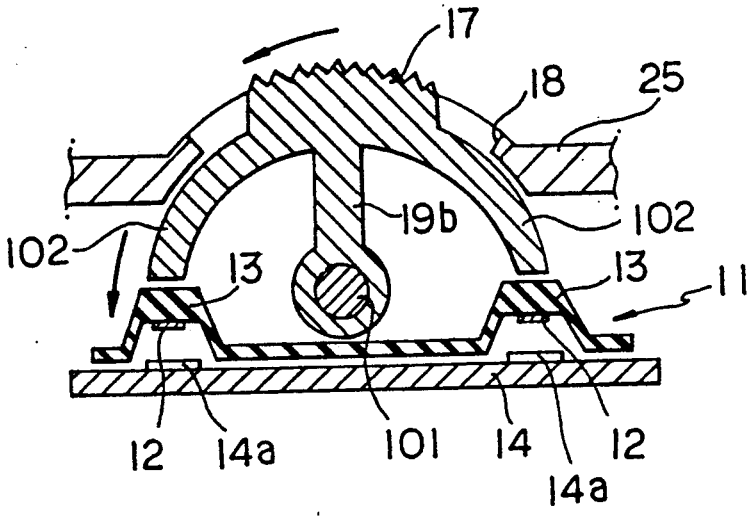
FIG. 9 is a sectional view showing a eighth embodiment of the invention.

FIG. 9 illustrates an eighth embodiment of the invention which is used with a modified example of the convex operator. In this embodiment, the cooperative pressing element 20 is integrally formed with the operating knob 17 itself. The operating knob 17 has a center projection 19*b* , whose leading end pivotally mounted on a rotary shaft 101. A pair of cooperative projections 102 is extended from a joint between the operating knob 17 and the center projection 19*b* in an arc in opposite directions. The leading end of each cooperative projection 102 is opposed to its corresponding projection 13. The rubber switch 11 itself is the same structure as in the embodiments shown in FIGS. 2A, 2B and 3A, 3B.

With the eighth embodiment mentioned above, when the operating knob 17 is rotatably moved from a neutral position in either the right-hand or left-hand direction in the drawings, the cooperative projection pair 102 is moved in the same direction so that one cooperative projection 102 at its leading end presses the corresponding projection 13. This brings the contact 12 into engagement with the substrate 14 to establish an electrical connection between them. When the operating knob 17 is released, the contact 12 is moved away from the contact 14*a* on the substrate 14 due to the resilience of the projection 13 to return the operating knob 17 to its initial neutral position.

Figure 10A:
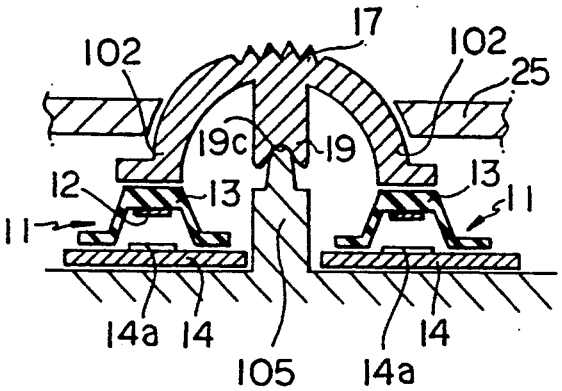
FIGS. 10A and 10B are sectional views showing a ninth embodiment of the invention.
Figure 10B:
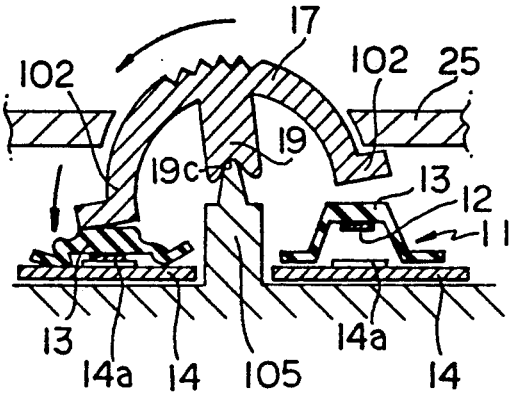

FIGS. 10A and 10B illustrate a ninth embodiment of the invention which is also used with a modified example of the convex operator to provide an alternative example of the eighth embodiment. Specifically, the actuator projection 19 is provided with a V-shaped retaining groove 19*c* at its leading end. On the side near the substrate 14, a knife edged retaining projection 105 is adapted to be received in the retaining groove 19*c*. Thus, the operating knob 17 is pivotally movable about the retaining projection 105 in right and left directions in the drawings. The rubber switch 11 itself is substantially the same structure as in the embodiments shown in FIGS. 2A, 2B and 3A, 3B.

When, in the ninth embodiment, the operating knob 17 is pivotally moved from a neutral position in either the right-hand or left-hand direction, the cooperative projection pair 102 is moved in the same direction so that one cooperative projection 102 at its leading end presses the corresponding projection 13 as shown in FIG. 10B. This brings the contact 12 into engagement with the substrate 14 to establish an electrical connection between them. When the operating knob 17 is released, the contact 12 is moved away from the contact 14*a* on the substrate due to the resilience of the projection 13 to return the operating knob 17 to its initial neutral position.

Figure 11A:
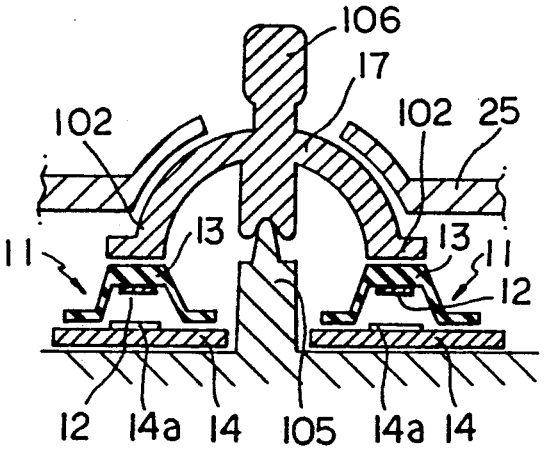
FIGS. 11A and 11B are sectional views showing a tenth embodiment of the invention.
Figure 11B:
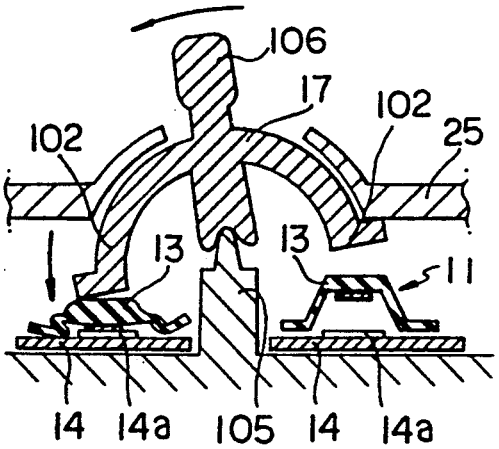

FIG. 11A and 11B show a tenth embodiment of the invention which is an alternative example of the ninth embodiment. It is structured similarly to the ninth embodiment except for an operating lever 106 projecting from the operating knob 17.

Figure 12A:
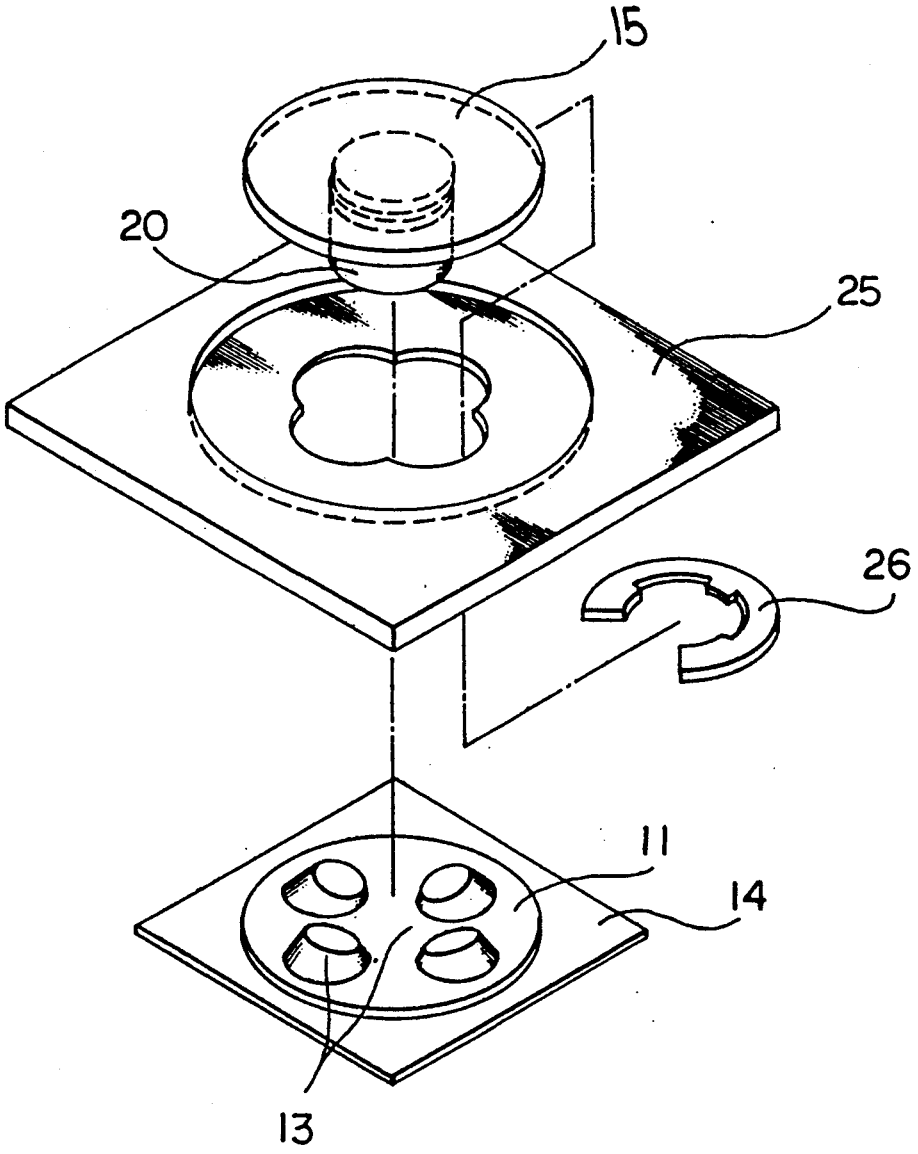
FIG. 12A is an exploded perspective view showin an eleventh embodiment of the invention.
Figure 12B:
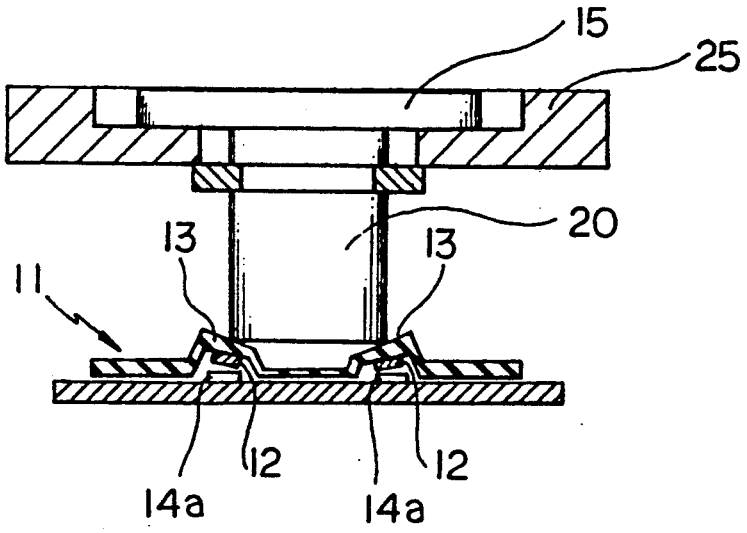
FIG. 12B and 12C are sectional views of the eleventh embodiment.
Figure 12C:
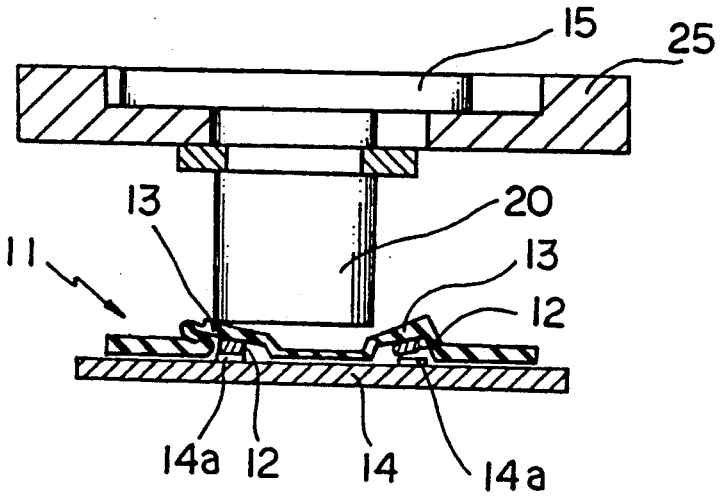
Figure 13:
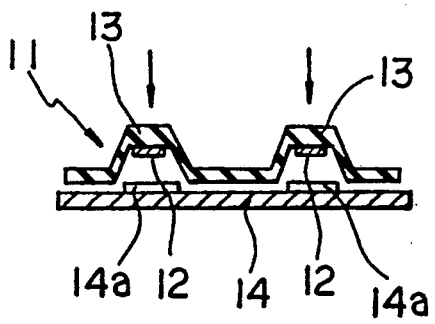
FIG. 13 is a sectional view showing one example of the rubber switch.

FIGS. 12A through 12C show an eleventh embodiment of the invention. In this embodiment, the rubber switch 11 mounted on the substrate 14 is provided with at least three projections 13 (four in this embodiment) extending radially from the center. The operating member 15 mounted on the planar surface 21 of a case 25 is arranged to be slidable toward the projections 13. With sliding movement of the operating member 15, the cooperative press member 20 presses the corresponding one of the projections 13 of the rubber switch 11. This brings the contact 12 into engagement with the contact 14*a* on the substrate 14 for establishing an electrical connection, as shown in FIG. 12C. Reference numeral 26 in FIG. 12A indicates a stopper ring.

A rotatable dial mechanism for operating the switching device as described above will now be described. FIGS. 14 through 17 illustrate an embodiment in which a dial mechanism is employed as a select switch for a camera. A flat plate top cover 111 serving as a support element is provided with a projecting finger rest 112 which has a quarter-spherical shaped surface. A vertical aperture 114 is located adjacent to a cross-sectional plane wall 113 extending generally along the diameter of the quarter-spherical finger rest 112, from which the operating member of the rotatable dial 120 projects. The operating member 121 is of a quarter-spherical shape to form a hemisphere with the finger rest 112 projecting from the top cover 11. Linear ridges 122 are formed on the surface of the operating member 121 for easier operation by a of finger.

The rotatable dial 120 is provided at the under side of the top cover 111 with a stem 123 projecting from the finger rest side and also from the opposite side to. The extension of the stem 123 on the finger rest side is integrally provided with a switch arm 124. The top cover 111 has a stem groove 115 to receive the stem 123. The stem 123 received by the stem groove 115 is held by a holder plate 117 fixedly mounted on the under side of top cover 11 by a fixing screw 116 so as to retain the entire rotatable dial 120.

Figure 14:
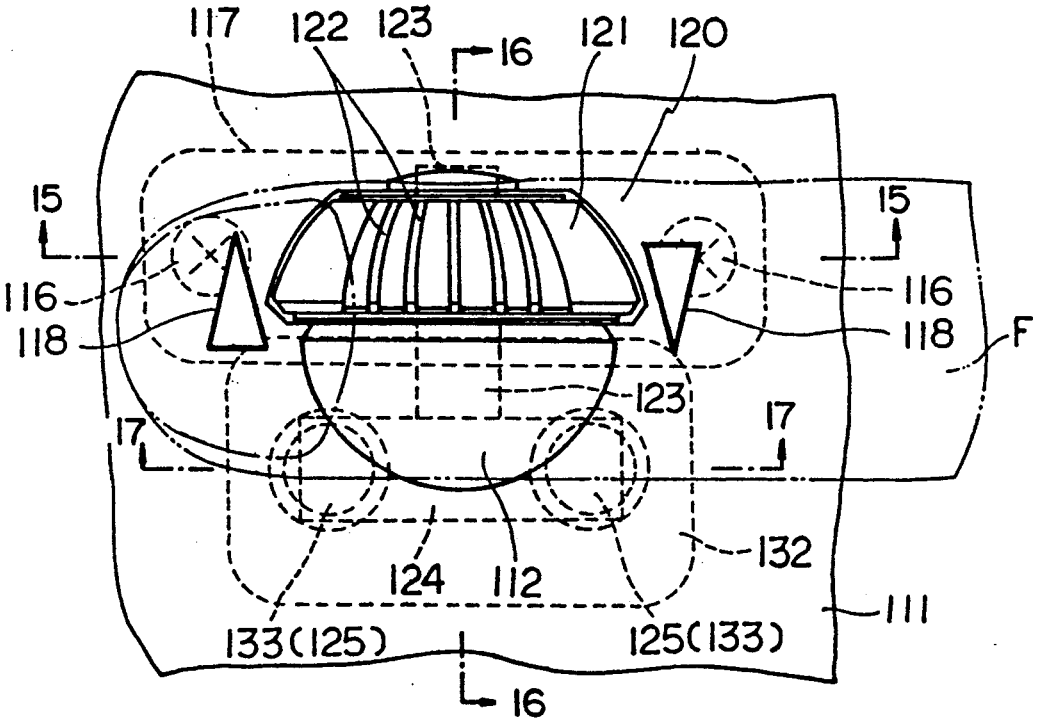
FIG. 14 is a plan view of an embodiment of the invention which is comprised as a dial type switching device.
Figure 15:
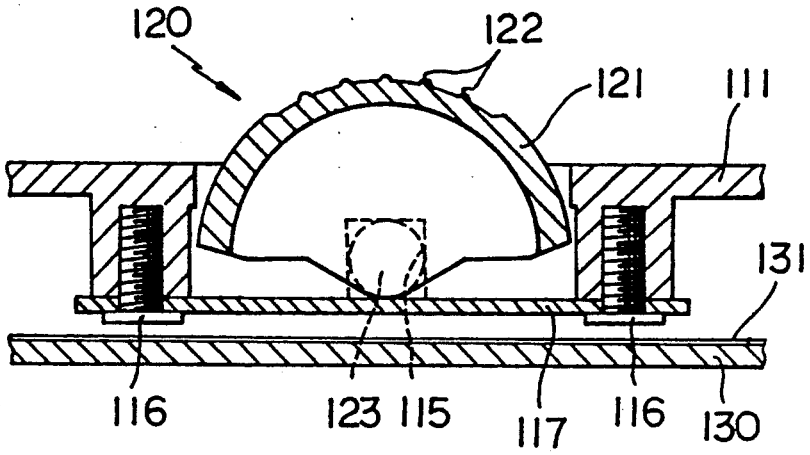
FIGS. 15, 16, and 17 are sections of FIG. 14 taken along the lines II—II, III—III and IV—IV, respectively.
Figure 16:
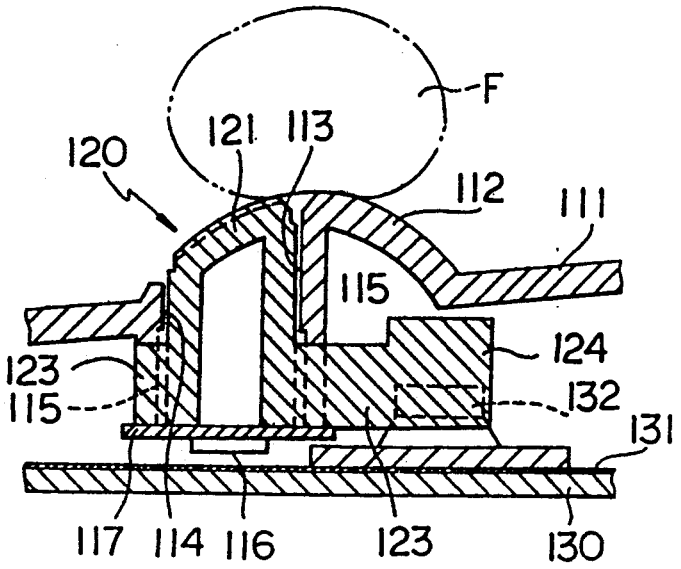
Figure 17:
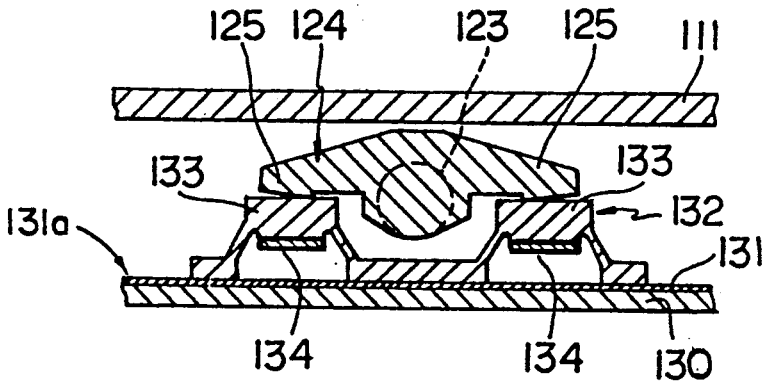

The switch arm 124 includes a pair of press arms 125 symmetrically located on opposite sides of the stem 123. The top cover 111 additionally includes a board retaining plate 130 fixedly mounted on its under side. A flexible print circuit board 131 and a rubber switch 132 are secured to the board retaining plate 130. The rubber switch 132 has a pair of resilient projections 133 corresponding to the press arm pair 125. Each resilient projection 133 has at its inner surface a conductive rubber element 134 which is normally kept out of engagement with the corresponding contact due to the resilience of the resilient projection 133. The resilient projection 133 of the rubber switch 132 is normally in resilient engagement with the press arm 125 to hold the rotatable dial 120 in its neutral position by virtue of the resilience. Numerals 118 in FIG. 14 are is indications of the rotational direction of the rotatable dial 120.

With the arrangement of the rotatable dial mechanism as described, when it is rotated in either the right-hand or left-hand direction by a finger on the operating member 121, the stem 123 is rotated within the stem groove 115 so that the switch arm 124 is swung in different directions. One of the press arms 125 deforms the resilient projection 133 against its resilience to bring the conductive rubber element 134 into engagement with the corresponding contact on the FPC board 131. A certain switch or select operation then takes place. When the operating force is released, the resilient projection 133 and the switch arm 124 are returned to the neutral position due to resilience of the resilient projection 133.

The operation described above is achieved by placing a finger F over the generally semi-spherical finger rest 112 and the operating member 121. While the operator at this time tilts the finger F toward the operating member 121 or applies a force to the operating member 121 to rotate the operating member 121, part of the finger F always remains on the finger rest 112. Consequently, the finger F can be held in a stable position while rotating the dial, ensuring a comfortable feeling of operation. When the dial is not rotated, the finger F can be either placed equally over the operating member 121 and the finger rest 112 or tilted toward the finger rest 112, ensuring a stable rest position.

Furthermore, in this rotatable dial mechanism, the finger rest 112 and the operating member 121 together form a semi-spherical surface that gives a good feeling of operation while rotating the dial or locating it for blind operation as well as a neat appearance.

As fully described above, the switching device according to the invention restores the operating element to its neutral position by virtue of the resilient restoring action of the switch. It is therefore not necessary to provide any contact on the operating element or any extra member for holding the operating element in the neutral position. This assures a simplified structure of the device. Furthermore, since a semi-spherical portion is formed by the rotatable dial and the fixed finger rest in the rotatable dial mechanism, a comfortable touch is ensured when operating the dial or when feeling it for blind operation. Also, it is convenient for the operator to use a since he/she tends to slightly push a finger toward the rotatable dial during operation of the dial, while shifting it to the finger rest when operation is not required. For this reason, stability in the rest position and ease in operation can both be achieved.

What is claimed is:

1. An operating member for a switching device, said operating member comprising:

(a) a support structure;

(b) a dial being rotatably mounted for movement about an axis on said support structure, said dial including at least a portion of a generally convex quarter-spherical surface; and (c) a finger rest being fixedly mounted on said support structure adjacent to said dial, said finger rest including a generally convex quarter-spherical surface, said dial and said finger rest in combination forming a convex semi-spherical surface.

2. The operating member for a switching device according to claim 1, wherein said finger rest is integrally formed with said support structure.

3. The operating member for a switching device according to claim 1, wherein said support structure is part of a camera.

4. The operating member for a switching device according to claim 1, further comprising a cooperating member connected to said dial for actuating a switch of said switching device.

5. The operating member for a switching device according to claim 4, wherein said cooperating member is rotatably mounted for movement about an axis on said support structure.

6. The operating member for a switching device according to claim 5, wherein the axis for said dial and said axis for said cooperating member are the same axis.

7. An operating member for a switching device, said operating member comprising:

(a) a support structure;

(b) a dial projecting above said support structure and being mounted for movement about an axis on said support structure, said dial including a first substantially convex surface; and (c) a finger rest projecting above said support structure adjacent to said dial, said finger rest including a second substantially convex surface, said second surfaces being elongated transversely to said axis, said first surface of said dial and said second surface and said finger rest in combination together forming a substantially convex surface, said first and second surface being substantially contiguous to allow a finger of a user to be simultaneously and comfortably placed on both said dial and said finger rest, a cooperating member connected to said dial element for actuating a switch of said switching device; said cooperating member being rotatably mounted for movement about an axis on said support structure.

8. The operating member for a switching device according to claim 7, wherein said finger rest is integrally formed with said support structure.

9. The operating member for a switching device according to claim 7, wherein the axis for said dial and said axis for said cooperating member are the same axis.

10. The operating member for a switching device according to claim 7, wherein said support structure is part of a camera.

* * * * *